United States Patent [19]

Ogata et al.

[11] 4,423,353

[45] Dec. 27, 1983

[54] HIGH-PRESSURE SODIUM LAMP

[75] Inventors: Yoshiro Ogata, Ibaraki; Haruo Yamazaki, Moriyama; Takashi Ikeda, Takatsuki; Hidezoh Akutsu, Kobe, all of Japan

[73] Assignee: Matsushita Electronics Corporation, Osaka, Japan

[21] Appl. No.: 272,178

[22] Filed: Jun. 10, 1981

[30] Foreign Application Priority Data

| | | | |
|---|---|---|---|
| Jun. 17, 1980 | [JP] | Japan | 55-82645 |
| Oct. 3, 1980 | [JP] | Japan | 55-138969 |
| Jan. 19, 1981 | [JP] | Japan | 56-6924 |

[51] Int. Cl.[3] ..... H01J 61/30; H01J 61/36; H01J 61/073; H01J 61/22

[52] U.S. Cl. ..... 313/631; 313/634; 313/638

[58] Field of Search ..... 313/221, 220, 217, 631, 313/634, 636, 638

[56] References Cited

U.S. PATENT DOCUMENTS

| | | | |
|---|---|---|---|
| 3,363,134 | 1/1968 | Johnson | 313/220 |
| 3,832,590 | 8/1974 | Yamazaki et al. | 313/221 |
| 3,911,313 | 10/1975 | Makar, Jr. | 313/217 X |
| 3,932,782 | 1/1976 | Kopelman | 313/220 |
| 4,065,691 | 12/1977 | McVey | 313/220 X |

*Primary Examiner*—Palmer C. Demeo

*Attorney, Agent, or Firm*—Burgess, Ryan & Wayne

[57] ABSTRACT

A high-pressure sodium lamp in which the ends of an arc tube which is made of transparent single-crystal alumina and which contains sodium are sealed with feed-throughs each having an electrode extended from the inner end thereof.

Each feed-through is directly sealed to the inner wall surface of each end of the arc tube. In addition, each feed-through is formed with an enlarged-diameter portion which is directly sealed to the inner wall surface at each end of the arc tube and a reduced-diameter portion which is spaced apart from the inner wall surface at each end of the arc tube.

3 Claims, 4 Drawing Figures

HIGH-PRESSURE SODIUM LAMP

BACKGROUND OF THE INVENTION

The present invention relates to a high-pressure sodium lamp.

Incandescent lamps emit light of warm colors, have excellent color rendition and are low in cost so that they find a wide application in indoor lighting. However, with the increasingly serious energy problem, the low efficiency of incandescent lamps has become a problem. There is a strong demand for the development of discharge lamps which are compact in size yet capable of generating lumens equivalent to those of incandescent lamps of the ratings from 60 to 200 watts. To this end, there have been devised and demonstrated various types of high-pressure sodium lamps with high color rendition at the ratings of 150 to 400 watts. However, when such lamps are fabricated based upon the ordinary design criteria, there arise the problems that the lamp efficiency is extremely low and fabrication costs are relatively high.

In order to improve the luminous efficacy, single-crystalline alumina which has a higher degree of transmittance than conventional alumina ceramic is used in the fabrication of arc tubes. In this case, end caps made of alumina are fitted into the ends of an arc tube and metal tubes, each having an electrode, are mounted in the end caps so as to gas-tightly seal the ends of the arc tube. As a result, of the construction cracks are propagated at the sealed ends of the arc tube made of single-crystalline alumina and in the end caps.

SUMMARY OF THE INVENTION

One of the objects of the present invention is to provide a high-pressure sodium lamp which is compact in size yet has a higher degree of luminous efficacy.

Another object of the present invention is to provide a high-pressure sodium lamp in which the propagation of cracks at the sealed ends of an arc tube can be substantially eliminated.

A further object of the present invention is to provide a high-pressure sodium lamp which is inexpensive to fabricate.

Briefly stated, to the above and other ends, the present invention provides a high-pressure sodium lamp in which the ends of an arc tube made of transparent alumina are gas-tightly sealed with feed-throughs each having an electrode extended from the inner end thereof.

The above and other objects, effects and features of the present invention will become more apparent from the following description of preferred embodiments thereof taken in conjunction with the accompanying drawings.

DESCRIPTION OF THE PREFERRED EMBODIMENTS

Figure 1:
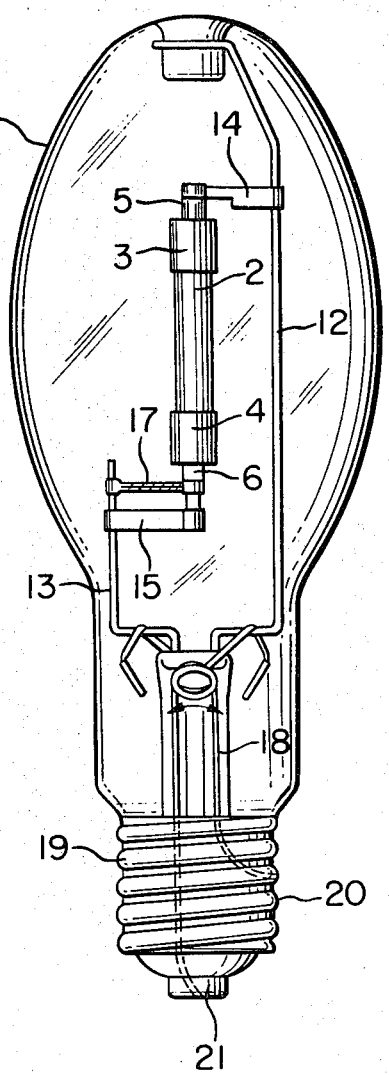
FIG. 1 is a sectional view of a high-pressure sodium lamp in accordance with the present invention.

First Embodiment, FIG. 1

A 50-watts, high-pressure sodium lamp with high color rendition shown in FIG. 1 has an outer jacket 1, which is evacuated and in which is disposed an arc tube 2. The arc tube 2 is a transparent alumina tube 4.1 mm in inner diameter and 0.8 mm in wall thickness. The end portions of the arc tube 2 are surrounded with heat-trapping foils 3 and 4 which have the function of trapping the heat and light radiated from electrodes to be described in detail below in the coldest spots in the tube between feed-throughs disposed behind the electrodes and the sealed ends of the arc tube 2, whereby the coldest spots may be maintained at high temperature. As a result, the pressure of sodium in the arc tube 2 can be maintained at high levels so that the self-reversal of D lines of sodium is enhanced and the width of every spectral line in the visible spectrum is increased. Hence, the high-pressure sodium lamp in accordance with the present invention realizes high color temperature and high color rendition as compared with the conventional HPS lamps. The pressure of sodium in the arc tube 2 can be varied over a relatively wide range depending upon the longitudinal or axial length of the heat trapping foils 3 and 4.

Figure 2:
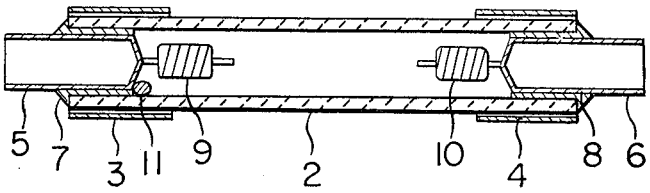
FIGS. 2, 3 and 4 show in longitudinal cross section three arc tubes in accordance with the present invention which may be used in the lamp as shown in FIG. 1.

In FIG. 2 is shown in detail the construction of one example of an arc tube 2. Tubular feed-throughs 5 and 6 are made of niobium and are about 0.22 mm in wall thickness. They are partially fitted into the ends of the arc tube 2 and gas-tightly seal them with ceramic cements 7 and 8. Electrodes 9 and 10 are extended axially inwardly from the inner ends of the feed-throughs 5 and 6 and spaced apart from each other by about 10 mm. Sodium amalgam containing about 78 mole % of sodium 11 and a Penning gas consisting of neon and argon are contained in the arc tube 2 at about 25 torr.

Referring back to FIG. 1, the arc tube 2 is supported in the outer jacket or bulb 1 with support or lead-in wires 12 and 13 and an insulation rod 16. One end of a support plate 14 is welded to the support or lead-in wire 12 while the other end thereof, to the feed-through 5. One end of a support plate 15 is welded to the support or lead-in wire 13 while the other end thereof, to the lower end of the insulation rod 16. The other or upper end of the insulation rod 16 is loosely fitted into the feed-through 6. The support or lead-in wire 13 and the feed-through 6 are electrically interconnected with a lead wire 17. The support or lead-in wires 12 and 13 are extended through a glass stem 18 and are connected to the shell 20 and contact 21 of a base 19.

The high-pressure sodium lamp of the type described above is so designed as to have a color temperature of about 2500 K° with the input of 50 watts. When operated with the input of 50 watts, it exhibits the luminous efficacy of 47 lumen per watt. There has been devised and demonstrated a conventional 50-watts, high-pressure sodium lamp with high color rendition in which the ends of an arc tube are sealed with feed-throughs having electrodes at their inner ends through end caps. The luminous efficacy of such sodium lamp with the comparable ratings is 37 lumen per watt. Therefore, it is quite apparent that the high-pressure sodium lamp in accordance with the present invention has by far greater luminous efficacy than that of the conventional lamps. It may be due to the reduction in thermal loss at the ends of the arc tube that the luminous efficacy is improved as described above.

Even after the aging or use of 5,000 hours, almost no crack is observed at the ends of the arc tube which is made of alumina. The reason may be that since the wall thickness of the tubular feed-throughs 5 and 6 is very thin and of the order of 0.15 to 0.30 mm, the difference in thermal expansion and contraction between the alumina arc tube 2 and the feed-throughs 5 and 6 which seal the arc tube 2 is absorbed by the expansion and contraction of the feed-throughs 5 and 6.

In the case of the prior art lamp provided with the end caps as described previously, cracks were propagated at the ends of the arc tube after the aging or use of only less than 1,000 hours.

Since the high-pressure sodium lamp in accordance with the present invention can eliminate the end caps, considerable cost savings can be attained.

Figure 3:
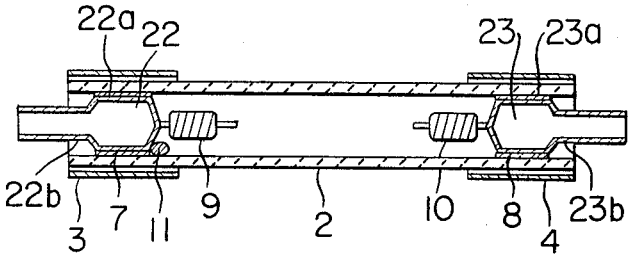

However, the arc tube construction as shown in FIG. 2, if the arc tube is made of a single-crystalline alumina, the complete elimination of residual stresses and extremely fine cracks which will cause cracking of the ends of the tube is extremely difficult because of the tube fabrication and cutting processes. However, the present invention also provides an arc tube as shown in FIG. 3 which may substantially overcome the above-described problem. FIG. 3 shows also an arc tube for a 50-watts, high-pressure sodium lamp with high color rendition. The arc tube 2 is made of single-crystalline alumina and is 4.1 mm in inner diameter. The ends of the arc tube 2 are sealed with tubular feed-throughs 22 and 23 and ceramic cements 7 and 8. The enlarged-diameter portions 22*a* and 23*a* of the feed-throughs 22 and 23 which are made into very intimate contact with the inner cylindrical wall surface of the arc tube 2 have an outer diameter of 4 mm and the reduced-diameter portions 22*b* and 23*b* of the feed-throughs 22 and 23 which are located adjacent to the ends of the arc tube 2 have the outer diameter of 3 mm. The feed-throughs 22 and 23 are formed with the reduced-diameter portions 22*b* and 23*b*, respectively, as described above so that annular spaces may be provided between the reduced-diameter portions 22*b* and 23*b* and the inner cylindrical surface of the arc tube 2. As a result, when ceramic cements 7 and 8 are heated and melted so as to seal the ends of the arc tube 2, they flow, due to capillarity, into the very narrow annular space about 0.05 mm in width between the enlarged-diameter portions 22*a* and 23*a* of the feed-throughs 22 and 23 and the inner cylindrical surface of the arc tube 2 so that they are securely bonded together. However, the molten cements 7 and 8 are not permitted to flow towards the end faces of the arc tube 2 and to fill the annular space defined between the reduced-diameter portions 22*b* and 23*b* of the feed-throughs 22 and 23 and the inner cylindrical wall surface of the arc tube 2. Consequently, when the ends of the arc tube 2 are sealed, the ceramic cements 7 and 8 are prevented from adhering to the inner cylindrical wall surface of the arc tube 2 behind the enlarged-diameter portions of the feed-throughs 22 and 23 and the annular end surfaces of the arc tube 2. It follows, therefore, that even if more or less stresses and extremely fine cracks remain at the sealed ends of the arc tube 2 made of single-crystalline alumina, the propagation of cracks at the ends of the arc tube 2 due to the residual stresses left after melting and solidification of ceramic cements 7 and 8 and the thermal stresses produced when the lamp is operated can be substantially eliminated.

So far the spacing between the inner cylindrical wall surfaces of the arc tube 2 and the reduced-diameter portions 22*b* and 23*b* of the feed-throughs 22 and 23 have been described as being 0.55 mm. In general, the conditions for melting ceramic cement for sealing the ends of the arc tube 2 due to capillarity as described previously are dependent upon not only the spacing between the arc tube 2 and the reduced-diameter portions 22*b* and 23*b* of the feed-throughs 22 and 23 but also the properties of the cement used and a metal or alloy which is used as feed-throughs. Irrespective of such melting conditions and with any cement which is currently used for sealing the ends of the arc tubes for high-pressure discharge lamps, the adhesion of the sealing cement to the annular end faces and their contiguous inner cylindrical wall surfaces of the arc tube 2 can be prevented if the spacing between the inner cylindrical wall surfaces of the arc tube 2 and the reduced-diameter portions 22*b* and 23*b* of the feed-throughs 22 and 23 is maintained greater than 0.2 mm.

The present invention can attain further effects and features as will be described below. That is, the feed-throughs 22 and 23 as shown in FIG. 3 are smaller both in surface area and cross section than the feed-throughs 5 and 6 as shown in FIG. 2. As a result, the thermal losses due to thermal radiation and conduction at the ends of the arc tube 2 as shown in FIG. 3 when the lamp is operated are considerably reduced and consequently the temperatures at the coldest points are further increased. As a consequence, the longitudinal or axial length of the heat trapping foils 3 and 4 which define the desired optical properties; that is, which maintain the sodium in the arc tube 2 at a predetermined pressure can be reduced as compared with the arc tube of the type as shown in FIG. 2. The fundamental function of the heat trapping foils 3 and 4 is to shield part of light produced by the discharge arc in the arc tube 2. It follows, therefore, that shortening the heat trapping foils 3 and 4 results in the direct increase in total lumen of the lamp. As compared with the lamp incorporating the arc tube 2 as shown in FIG. 2, the luminous efficacy of the 50-watts, high-pressure sodium lamp with high color rendition incorporating the arc tube as shown in FIG. 3 is increased further by about 3 lumen per watt.

Figure 4:
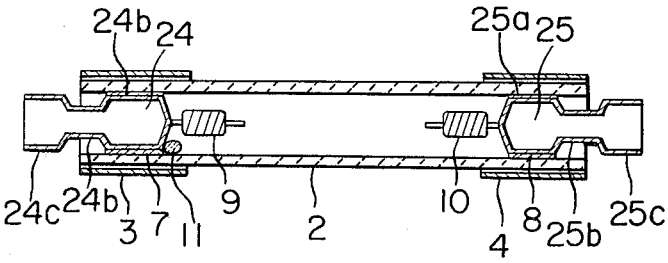

In FIG. 4 is shown a further example of an arc tube in accordance with the present invention for the 50-watts, high-pressure sodium lamp with high color rendition. This arc tube 2 is substantially similar in construction to the arc tube shown in FIG. 3 except that the outer ends of the feed-throughs 24 and 25 are terminated into the enlarged-diameter portions 24*c* and 25*c*, respectively. That is, the feed-throughs 24 and 25 have the inner enlarged-diameter portions 24*a* and 25*a*, the intermediate reduced-diameter portions 24*b* and 25*b* and the outer enlarged-diameter portions 24*c* and 25*c*, respectively. The arc tube as shown in FIG. 4 can also attain the same effects and features as described previously in conjunction with the second embodiment as shown in FIG. 3.

In the first, second and third embodiments, the feed-throughs have been described as being made of niobium, but it is to be understood that the same inventors conducted extensive studies and experiments and confirmed fact that even if the feed-throughs are made of other metals such as tantalium, zirconium, titanium or molybdenum, the propagation of cracks at the ends of the arc tube can be prevented. The costs of zirconium and titanium are especially lower than those of niobium and tantalium, so that the overall material costs of the arc tube can be reduced by about 25 to 35%.

The objects of the present invention will be attained even if the feed-throughs are made of niobium, zirconium or titanium containing a small amount of other elements or metals and the same effects and features as described previously can be obtained. Therefore, the present invention includes these materials. For instance, niobium may contain about 1 percent of zirconium and a titanium alloy containing a small amount of chromium, iron and/or aluminum may be used.

What is claimed is:

1. A high-pressure sodium lamp comprising an outer envelope, an arc tube made of transparent alumina containing sodium and supported within the outer envelope, and means for supplying electrical energy to said arc tube through feed throughs, the improvement which comprises: a single crystal alumina arc tube having cylindrical ends sealed with feed-throughs each having an electrode extending into the arc tube from the inner end thereof, each of said feed-throughs comprises an enlarged-diameter portion having a cylindrical outer wall sealed to the inner cylindrical wall surface of said arc tube and a reduced-diameter portion contiguous and concentric with said enlarged-diameter portion and defining an external annular space between the inner cylindrical wall surface of said arc tube and said feed-through.

2. A high-pressure sodium lamp as set forth in claim 1 wherein said feed-throughs are made of niobium, tantalum, titanium, zirconium or molybdenum.

3. A high-pressure sodium lamp as set forth in claim 1, wherein the space between the reduced-diameter portion of each of said feed-throughs and the inner cylindrical wall surface of said arc tube adjacent to each end thereof is greater than 0.2 mm.

* * * * *